US006235151B1

(12) United States Patent
Fagerlind et al.

(10) Patent No.: US 6,235,151 B1
(45) Date of Patent: May 22, 2001

(54) INHIBITING SCALING IN ALKALINE WASTE LIQUOR EVAPORATORS

(75) Inventors: Olof Fagerlind, Stockholm (SE); Heikki Jaakkola, Helsinki; Erkki Kiiskila, Karhula, both of (FI)

(73) Assignee: Andritz-Ahlstrom Oy, Espoo (FI)

( * ) Notice: Subject to any disclaimer, the term of this patent is extended or adjusted under 35 U.S.C. 154(b) by 0 days.

(21) Appl. No.: 09/299,000

(22) Filed: Apr. 26, 1999

(30) Foreign Application Priority Data

May 26, 1998 (SE) ..... 9801855-9

(51) Int. Cl.[7] ..... D21C 7/14

(52) U.S. Cl. ..... 162/48; 162/29; 162/41; 162/42; 162/43; 159/47.3

(58) Field of Search ..... 162/48, 30.1, 30.11, 162/29, 24, 37, 38, 40, 41, 42, 43, 60; 210/928, 724, 702, 919; 159/47.3, DIG. 13; 252/175

(56) References Cited

U.S. PATENT DOCUMENTS

| | | | | |
|---|---|---|---|---|
| 4,755,258 | | 7/1988 | Ryham . | |
| 5,120,448 | * | 6/1992 | Dorica et al. | 210/724 |
| 5,401,362 | * | 3/1995 | Lindberg | 162/37 |
| 5,540,816 | | 7/1996 | Andtbacka et al. . | |
| 6,024,833 | * | 2/2000 | Wennberg | 162/16 |
| 6,090,240 | * | 7/2000 | Eneberg | 159/47.3 |

FOREIGN PATENT DOCUMENTS

| | | |
|---|---|---|
| WO94/21857 | 9/1994 | (WO) . |
| WO96/14467 | 5/1996 | (WO) . |

OTHER PUBLICATIONS

Frederick, Jr. et al, "Preventing Calcium Carbonate Scaling in Black Liquor Evaporators", Part One of Two Parts, Southern Pulp and Paper Manufacturer/Aug. 1979, pp. 22–24.

Frederick, Jr. et al, "Preventing Calcium Carbonate Scaling in Black Liquor Evaporators", Part Two of Two Parts, Southern Pulp and Manufacturer/Sep. 1979, pp. 21–29.

* cited by examiner

*Primary Examiner*—Stanley S. Silverman
*Assistant Examiner*—Eric Hug
(74) *Attorney, Agent, or Firm*—Nixon & Vanderhye P.C.

(57) ABSTRACT

Calcium carbonate scaling is inhibited in a multi-stage alkaline waste liquor evaporation plant in a chemical cellulose pulp mill having a bleaching plant. Calcium-containing effluent from the bleaching plant is treated together with alkaline waste liquor in the evaporation plant. A portion of the alkaline waste liquor of the evaporation plant is supplied to the bleaching effluent to increase the carbonate content of the effluent. Then the bleaching effluent is heated to 110–160° C. by direct contact with a heating medium (e.g. steam, or secondary vapor) and maintained in a retention tank for a period of about 1–20 minutes to reduce the amount of dissolved calcium in the effluent. Finally the heat-treated bleaching effluent is evaporated with the alkaline waste liquor in the evaporation plant, with minimized scaling.

21 Claims, 1 Drawing Sheet

INHIBITING SCALING IN ALKALINE WASTE LIQUOR EVAPORATORS

FIELD OF THE INVENTION

The present invention relates to a method of and system for inhibiting fouling of heat transfer surfaces in a multi-stage black liquor evaporation plant in a chemical cellulose pulp mill, in which black liquor (or other alkaline waste liquor) and bleaching effluent containing dissolved calcium or dispersed calcium salts or complexes are treated together in the evaporation plant.

BACKGROUND OF THE INVENTION

Alkaline cooks, in particular the sulphate process, have conventionally been performed in such a way that the comminuted cellulose fibrous material, commonly wood chips, and the cooking liquor are introduced into a cooking vessel (digester) and, the temperature is then raised to the cooking temperature, typically to 160–180° C., for a given period of time, so that lignin is detached from the wood, resulting in chemical pulp and alkaline waste liquor, called black liquor in the kraft process. In a sulphate process, the cooking liquor is typically white liquor, which is a mixture of NaOH and $Na_2S$. The black liquor contains dissolved lignin, salts of organic acids, extractives, and a significant amount of inorganic compounds.

As a rule, the inorganic components are recovered from the black liquor, whereas the organic part is used as combustible matter. For recovery, the black liquor is evaporated to a higher dry matter content (70–90%) in a multi-stage evaporation plant. An evaporation plant operates most commonly in such a way that the vapor having the highest pressure produced in the evaporator is used to heat the evaporator having the next highest pressure. Typically, an evaporation plant comprises 5–7 stages.

A common problem in black liquor evaporation plants is the fouling of heat transfer surfaces, which decreases the efficiency of the heat transfer process. Fouling increases with increasing dry matter content and temperature of the black liquor. In order to make the evaporation plant operate satisfactorily, the fouled surfaces need to be cleaned from time to time.

The worst problems with fouling in black liquor evaporation plants are connected with calcium carbonate scaling. Scales caused by calcium primarily comprise crystalline calcium carbonate scales, or binary salt scales of calcium carbonate and sodium carbonate. Solubility of calcium carbonate is poor. When calcium ions are precipitated as calcium carbonate particles in the black liquor, they remain in the liquid as crystalline particles and thus do not form scale on the heat transfer surfaces.

One of the most significant objectives of the pulp and paper industry in attempting to limit the environmental impact of pulp and paper mills is the minimization of liquid discharges from the mill, in particular from the bleach plant. Commonly referred to as "closing the bleach plant", this objective usually entails some way of collecting and re-using all the liquid effluents from the bleach plant with minimal discharge to the surrounding environment. In the past, this objective was partially achieved in practice by recirculating alkaline bleach plant effluent to the brownstock washing stage and ultimately to the alkaline recovery system.

The recirculation of acidic bleach plant effluents is much more difficult. These acidic effluents, for example, from an acid wash stage (A), an acidic or neutral chelation stage (Q), an acidic ozone stage (Z), or other acidic treatment stage, cannot be returned directly to the conventional recovery system because they contain metals dissolved from pulp.

Finnish patent application 944808 and WO patent application 96/12063 disclose a novel acid treatment in which hexenuronic acid groups are removed from chemical pulp. These acids are removed by adjusting the pH of the pulp to the range of 2–5, preferably 2.5–4, and by adjusting the temperature of the pulp to 90–110° C., and holding the pulp at these conditions for a certain period of time. Also acid soluble metals, e.g. Ca, Mg etc., can be removed efficiently from the pulp by this treatment.

Bleaching effluents, especially acidic effluents, contain undesirable metal ions which can negatively impact the processes and equipment. These metals were previously sewered with acidic bleach plant effluents. In a new closed mill concept it has been proposed that the acidic effluents be evaporated either alone or combined with the alkaline effluents. The preconcentrated effluents can be further evaporated together with black liquor and fed to a recovery boiler. Acidic effluent contains, in particular, a large amount of soluble calcium. Therefore, combining bleaching effluents and filtrates with black liquor may add to the formation of calcium carbonate scale on heat transfer surfaces of a black liquor evaporator which scale negatively impacts the operation of the evaporation plant, as described above. Alkaline effluents may also contain soluble calcium in a detrimental amount if carbonate is not present in a sufficient amount for formation of calcium carbonate.

Co-pending U.S. application Ser. No. 09/026,562 filed Feb. 20, 1998 discloses a method of inhibiting fouling of heat transfer surfaces in a multi-stage alkaline waste liquor evaporation plant by heat-treating a calcium-containing liquor to be treated in the evaporation plant. The calcium-containing liquor is heated to about 110–145° C., and the liquor is maintained at that temperature to reduce the amount of calcium in the liquor by precipitating calcium carbonate, and the heat-treated liquor is evaporated for combustion.

An object of the present invention is to provide a cost-effective and efficient method of inhibiting calcium scaling of the heat transfer surfaces in a black liquor evaporator when bleaching effluent is treated.

SUMMARY OF THE INVENTION

According to one aspect of the present invention there is provided a method of inhibiting fouling of heat transfer surfaces in a multi-stage alkaline waste liquor (e.g. black liquor) evaporation plant in a chemical cellulose pulp mill having a bleaching plant which discharges a calcium containing effluent, comprising: (a) Supplying a portion of the alkaline waste liquor (e.g. black liquor) from the evaporation plant to the bleaching effluent to increase the carbonate content of the effluent. (b) Heating the bleaching effluent from (a) by direct contact with a heating medium. (c) Maintaining the heated bleaching effluent from (b) for a period of time between about 1–20 minutes to reduce the amount of calcium in the effluent by precipitating calcium carbonate. And, (d) evaporating the heat-treated bleaching effluent from (c) with black liquor in the evaporation plant to inhibit fouling of heat transfer surfaces in the evaporation plant.

The present invention is based upon the principle that the detrimental scales on the heat transfer surfaces may be inhibited by adjusting the carbonate ion content of a calcium-containing bleaching effluent and heat treating the effluent before evaporation. During heat treatment calcium ions are released from calcium salts and complexes present in the effluent. The released calcium ions form, together with the carbonate ions in the liquor, solid calcium carbonate, which stays in the liquid and does not precipitate (and thus does not form scale) as the heat-treated bleaching effluent is evaporated in a black liquor evaporation plant.

Bleaching effluents do not usually contain carbonate ions in a sufficient amount to precipitate calcium. According to the invention, however, alkaline waste liquor, like black liquor, is used as a source of carbonate by adding it to the bleaching effluent. Preferably the carbonate ion content in the bleaching effluent is increased over the stoichiometric amount required for formation of calcium carbonate.

Typically, the invention is realized in a chemical cellulose pulp mill, where the calcium content of the black liquor is not so high that it would result in scaling in the evaporation plant. Thus, it is not required that the black liquor be treated to decrease the calcium content thereof. According to the invention such black liquor can be used to increase the carbonate content of the bleaching effluent so that the calcium precipitates as solids in the effluent.

It is possible to adjust the pH of the bleaching effluent to a sufficiently high value by adding a proper amount of black liquor. Typically if the pH is above 11, preferably above 12, the calcium precipitates out. If the residual alkali of the black liquor is too low, other alkaline liquor, such as green liquor, white liquor, or sodium hydroxide solution, may be added with the black liquor to the bleaching effluent to raise the pH.

The heat treatment is performed at a temperature between about 110–160° C., suitably about 110–145° C., preferably between 115–140° C. The heat treatment time is preferably between 1–20 minutes, most preferably between about 5–10 minutes.

The present invention is very advantageous for the treatment of acidic or neutral bleaching effluent comprising filtrate originally coming from an acidic bleaching stage. Typically the bleaching effluent is a filtrate or a combination of filtrates coming from one or more of the following stages: an acid wash stage (A), an acidic or neutral chelation stage (Q), an acidic ozone stage (Z), an acidic peroxide stage (Pa), or a hot acid stage for removal of hexenuronic acid groups from pulp. Filtrate is formed in a wash or thickening stage following an acidic bleach stage. It contains large amounts of calcium, which is dissolved from pulp in the acidic stage. The filtrate can be passed directly from the wash or thickening stage to the heat treatment of the invention. Alternatively, the filtrate, depending on the bleaching sequence, may flow countercurrently to the pulp, e.g. to a preceding bleaching stage, after which it is taken to the heat treatment of the invention. The bleaching effluent treated according to the invention may also be a combination of filtrates from different stages. It may also contain e.g. filtrate from an alkaline bleaching stage. It is important for proper practice of the invention that the bleaching effluent to be treated has a high content of calcium but a pH and carbonate ion level thereof too low to precipitate the calcium out.

Preferably the bleaching effluent is preconcentrated before heat treatment in order to decrease the volume to be treated in a heat treatment vessel. Preferably, the effluent is preconcentrated by evaporation, but other ways may alternatively or additionally be utilized, e.g. membrane processes. The bleaching effluent is preferably preconcentrated to a dry matter content of between about 5–10%.

The heat treatment in accordance with the invention is able to protect evaporators against fouling when the bleaching effluent is evaporated in the black liquor evaporation plant. The basic principle of the heat treatment of the invention is to create scaling-promoting conditions as early as in the heat treatment vessel, so that scaling does not take place in the corresponding evaporator vessel itself. The invention provides a method which is cost-effective with respect to heat economy, as only a stream of bleaching effluent and a small partial stream of black liquor (e.g. between about 10–20% of the total amount from the third stage) are heat-treated together; that is, it has been discovered that it is not necessary to treat the whole black liquor stream of an evaporation plant. Typically the bleaching effluent and black liquor are mixed in a ratio of between about 2:1 to 5:1, typically about 3:1. Naturally the proper ratio depends on the properties of the bleaching effluent and black liquor, such as calcium content, pH etc.

The method is also energy-efficient, as secondary vapor generated in the evaporation plant may be used in the heat treatment for heating the mixture of bleaching effluent and black liquor.

The method in accordance with the invention may be applied not only in connection with a sulphate pulping process, but also in connection with other alkaline pulping processes, such as a soda pulping process or an alkaline sulfite pulping process; that is the alkaline waste liquor may be black liquor or any waste liquor from other alkaline pulping processes.

A suitable dry matter content of the black liquor used in the heat treatment is dependent upon the properties of the liquor, but is typically 35–45%. A typical point where a partial stream of the black liquor is taken to the heat treatment in a seven-stage counter-current evaporation plant is prior to the second stage or the third stage.

In the method according to the invention, a mixture of bleaching effluent and black liquor, such as sulphate black liquor, is heated with direct contact with a hot heating medium, so that there is no risk of the fouling of a heat exchanger during the heat treatment. It is possible to use heating steam or vapor which is most easily available at the mill. Suitable steam or vapor may be, for example, low-pressure fresh steam, or secondary vapor from the first evaporation stage in the direction of steam, so that the use of fresh steam is avoided. Suitable secondary vapor is available at an evaporation plant in which the black liquor is evaporated in the final stage to a high dry matter content (75–90%), medium pressure steam being used in the final evaporation.

Instead of steam or vapor, the bleaching effluent to be heat-treated may alternatively be heated with a hotter liquor, or liquid slurry.

In the heat treatment procedure, the retention tank is preferably a separate vessel. The contact between the mixture of bleaching effluent and black liquor and the vapor may be provided, for example in a separate condenser ahead of the retention tank, or in the retention tank. The most preferable apparatus arrangement depends, however, on the temperature and the pressure required for the heat treatment, as well as on the connections and conditions of the evaporation plant.

According to another aspect of the invention a multi-stage evaporation plant assembly in a cellulose pulp mill is provided that has minimized calcium carbonate scaling. The assembly comprises: A plurality of distinct evaporators defining the multiple stages. A bleach plant. A first conduit withdrawing concentrated alkaline waste liquor from one of the distinct evaporators, the conduit having a first branch leading directly to a second evaporator and a second branch. A second conduit operatively connected to a bleach plant acidic effluent and to the second branch, so that the alkaline waste liquid in the second branch mixes with acidic bleach plant effluent in the second conduit. A common conduit for the mixture of alkaline waste liquor and acidic bleach plant effluent. A steam direct heater connected to the common conduit. A retention tank connected to the steam direct heater. And, the retention tank connected to the another evaporator. In the assembly one of the distinct evaporators may comprise a stage III evaporator, and the second evaporator may comprise a stage II evaporator; and the assembly may further comprise an indirect heat exchanger preheater connected to the common conduit between the second branch and the direct steam heater.

DETAILED DESCRIPTION OF THE DRAWING

Figure 1:
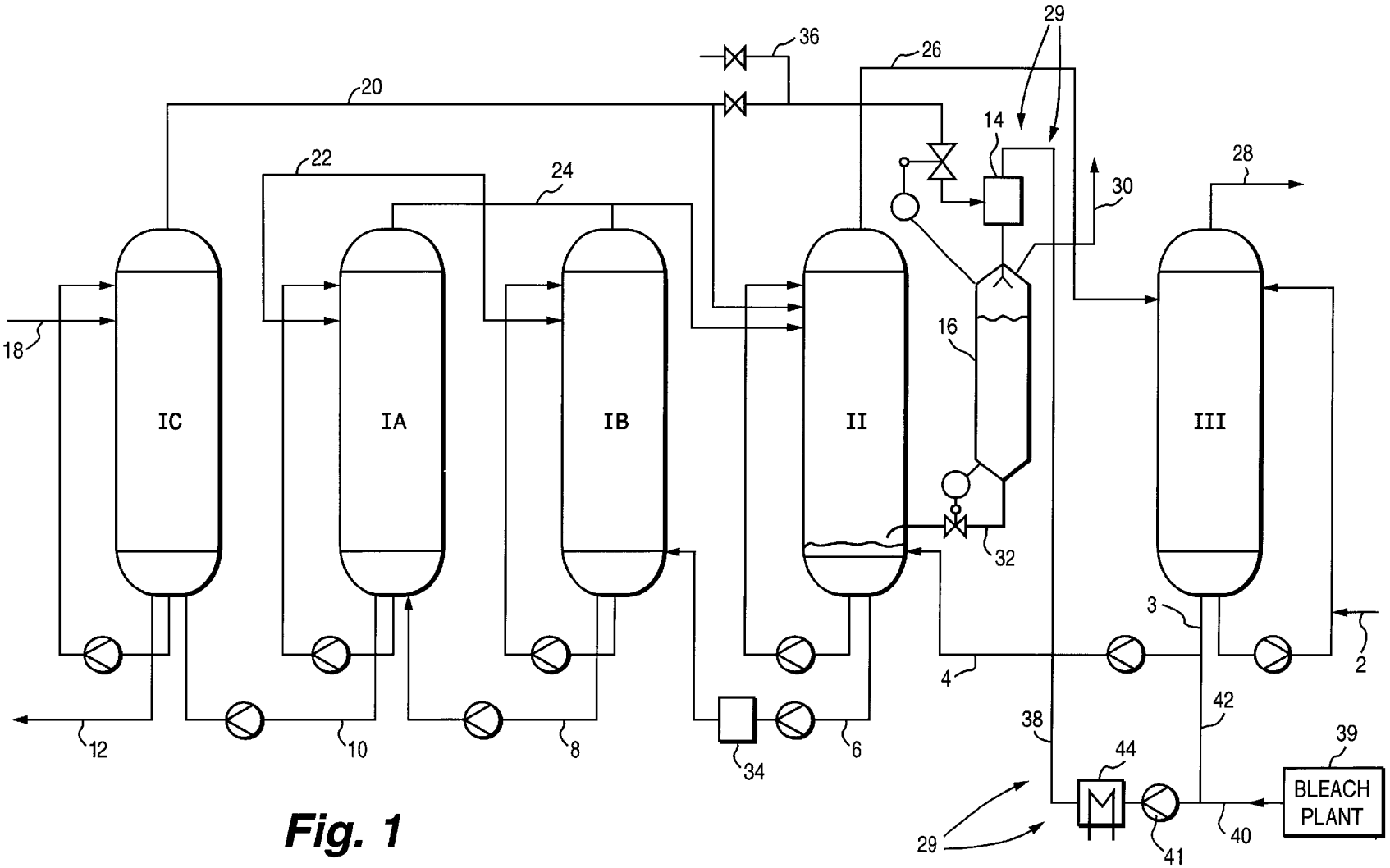
FIG. 1 schematically illustrates an exemplary apparatus according to the invention for practicing the method of the present invention.

FIG. 1 illustrates the front end of a multi-stage evaporation plant seen from the flow direction of the steam. In this case, the evaporation plant comprises successive stages operating at successively decreasing pressures and temperatures, the first three stages I–III being illustrated, but typically the evaporator has 5–7 stages. Stage I comprises steps IA, IB, and IC. The evaporators schematically illustrated in FIG. 1 are falling-film evaporators, but other conventional evaporators capable of evaporating black liquor may be used.

The liquor from stage IV (not shown) is brought through line 2 to stage III, in which the evaporated liquor is led through lines 3, 4 to stage II. Line 3 is a first conduit, and has a first branch 4 leading to the evaporator of stage II, and a second branch 42. From stage II the liquor flows further in line 6 to the first stage, which comprises two steps IA, IB connected in series on the liquor side by line 8, and step IC. The liquor is first evaporated in step IB, and then it is introduced into step IA. Subsequently, the liquor is taken through line 10 to final evaporation in step IC, in which the liquor is evaporated to a high dry matter content, i.e. about 75–90%, and from which the strong liquor is discharged through line 12 to combustion in a recovery boiler or the like.

Step IC of stage I is operated by the medium pressure steam from line 18. The secondary vapor generated in step IC is directed through line 20 to stage II to be used as heating steam. The pressure of medium pressure steam is typically 9–17 bar(g). Steps IA, IB of the first stage are connected in parallel on the steam side, low pressure fresh steam from line 22 being used therein. The pressure of low pressure fresh steam is typically 2–4 bar(g), and thus the secondary vapor separated from the black liquor is led through line 24 to stage II. In a corresponding way, the rest of the stages utilize secondary vapor having been generated in the corresponding preceding stages. The secondary vapor of stage II is introduced via line 26 to be used as heating steam in stage III, the secondary vapor of stage III in line 28 being then used in a corresponding way in stage IV (not shown), etc.

An exemplary heat treatment system according to the invention is provided between stages II and III, and is shown generally by reference numeral 29. However the system 29 may be provided between other stages. The main components of the system 29 are a direct steam heater 14 and a retention tank 16 vented at 30, however it may also include first conduit branch 42, second conduit 40, pump 41, common conduit 38, and pre-heater 44. Effluent from the bleaching plant 39 is transported by second conduit 40. A small partial stream of black liquor, typically 10–20% of the stream to be evaporated in line 3 (e.g. at a consistency of between about 35–45%), is brought through line 42 and mixed with the bleaching effluent in line 40. The mixture may be pumped by pump 41 to the indirect heat exchanger 44, and pre-heated therein. The mixture is pre-heated in heat exchanger 44 to about 80–98° C., e.g. about 90° C., for example. Through common conduit 38, the mixture flows into the steam heater 14, in which it is heated by direct contact with a heating medium, such as the vapor coming from step IC through line 20. The mixture is heated to the temperature required for heat treatment, i.e. to between about 110–145° C.

To form a calcium carbonate precipitate the mixture of the black liquor and bleaching effluent is maintained under pressure for about 1–20 minutes. For example the mixture may be maintained in the retention tank 16 for about 5 minutes, so that calcium carbonate precipitates out and can be removed. After this, the mixture is passed from the tank 16 through line 32 to stage II having a lower pressure and temperature than the retention tank 16, so that the liquor expands to this temperature and part of the water evaporates from the liquor in the form of steam. This expansion may alternatively take place in a separate flash tank disposed in line 32 before stage II.

Solid calcium carbonate particles have been formed in the liquor prior to stage II. These particles may be removed, if desired, after stage II, for example by a conventional separator 34, such as a filter, clarifier, or centrifuge, in line 6, although this kind of separation is usually not necessary.

It is not only secondary vapor from step IC of stage I, but also low-pressure steam or vapor from line 36 and/or secondary vapor from steps IA, IB, that may be used as heating steam in heater 14. The secondary vapor may be compressed to increase the temperature thereof. These steam sources are only exemplary, the most preferred steam flow for any particular situation being dependent upon the connections of each evaporator.

EXAMPLE

In laboratory trials effluent from an ECF (elemental chlorine free) bleaching plant 39 and black liquor from the third evaporation stage III were mixed in line 40 in a ratio of 5:1. The content of soluble calcium was 2,400 mg/kg DS. The mixture was heated by direct content with steam in steam heater 14 to about 140° C., and was held in tank 16 at about 140° C. for 15 min. As a result of the treatment in 44,14 and 16, the content of soluble calcium was reduced about 90%.

The invention specifically encompasses all narrower ranges within each broad range. For example 115–140° C. includes 116–138, 138–140, 120–130, and all other narrower ranges.

Although the invention is hereby shown and described in accordance with what is presently regarded as the most practical and the most preferable embodiment, it is clear to those skilled in the art that many modifications may be made within the scope of the invention, which scope is to be accorded the broadest possible interpretation of the appended claims, so that it encompasses all corresponding arrangements and processes.

What is claimed is:

1. A method of inhibiting fouling of heat transfer surfaces in a multi-stage alkaline waste liquor evaporation plant in a chemical cellulose pulp mill having a bleaching plant which discharges a calcium containing effluent, comprising:

(a) supplying a portion of the alkaline waste liquor from the evaporation plant to the bleaching effluent to increase the carbonate content of the effluent, and providing a combined effluent;

(b) heating the combined effluent from (a) by direct contact with a heating medium;

(c) maintaining the heated combined effluent from (b) for a period of time between about 1–20 minutes to reduce the amount of calcium in the effluent by precipitating calcium carbonate; and (d) evaporating the heat-treated combined effluent from (c) and alkaline waste liquor, in the evaporation plant, to inhibit fouling of heat transfer surfaces in the evaporation plant.

2. A method of inhibiting fouling of heat transfer surfaces in a multi-stage alkaline waste liquor evaporation plant in a chemical cellulose pulp mill having a bleaching plant which discharges a calcium containing effluent, comprising:

(a) supplying a portion of the alkaline waste liquor from the evaporation plant to the bleaching effluent to increase the carbonate content of the effluent, and providing a combined effluent;

(b) heating the combined effluent from (a) by direct contact with a heating medium;

(c) maintaining the heated combined effluent from (b) for a period of time between about 1–20 minutes to reduce the amount of calcium in the effluent by precipitating calcium carbonate;

(d) evaporating the heat-treated combined effluent from (c) and alkaline waste liquor, in the evaporation plant, to inhibit fouling of heat transfer surfaces in the evaporation plant; and (e) pre-evaporating the bleaching effluent prior to (a), to preconcentrate it to a dry matter content of between about 5–10%.

3. A method of inhibiting fouling of heat transfer surfaces in a multi-stage alkaline waste liquor evaporation plant in a chemical cellulose pulp mill having a bleaching plant which discharges a calcium containing effluent, comprising:

(a) supplying a portion of the alkaline waste liquor from the evaporation plant to the bleaching effluent to increase the carbonate content of the effluent, and providing a combined effluent;

(b) heating the combined effluent from (a) by direct contact with a heating medium;

(c) maintaining the heated combined effluent from (b) for a period of time between about 1–20 minutes to reduce the amount of calcium in the effluent by precipitating calcium carbonate;

(d) evaporating the heat-treated combined effluent from (c) and alkaline waste liquor, in the evaporation plant, to inhibit fouling of heat transfer surfaces in the evaporation plant; and wherein (a)–(c) are practiced using a ratio of bleaching effluent to alkaline waste liquor of between 2:1 to 5:1, in the combined effluent.

4. A method of inhibiting fouling of heat transfer surfaces in a multi-stage alkaline waste liquor evaporation plant in a chemical cellulose pulp mill having a bleaching plant which discharges a calcium containing effluent, comprising:

(a) supplying a portion of the alkaline waste liquor from the evaporation plant to the bleaching effluent to increase the carbonate content of the effluent, and providing a combined effluent;

(b) heating the combined effluent from (a) by direct contact with a heating medium;

(c) maintaining the heated combined effluent from (b) for a period of time between about 1–20 minutes to reduce the amount of calcium in the effluent by precipitating calcium carbonate;

(d) evaporating the heat-treated combined effluent from (c) and alkaline waste liquor, in the evaporation plant, to inhibit fouling of heat transfer surfaces in the evaporation plant;

(e) adjusting the pH of the bleaching effluent in (a) to a value higher than 12;

(f) prior to (a), evaporating the alkaline waste liquor in at least one evaporation stage to a dry matter content of between about 35–45%; and (g) pre-evaporating the bleaching effluent prior to (a), to preconcentrate it to a dry matter content of between about 5–10%.

5. A method as recited in claim 4 wherein the heat treatment in (c) is performed at a temperature of between 115–140° C. and with a retention time of between about 5–10 minutes.

6. A method as recited in claim 5 wherein (a)–(c) are practiced using a ratio of bleaching effluent to alkaline waste liquor in the combined effluent of between about 2:1 to 5:1.

7. A method as recited in claim 3 wherein the evaporation plant generates a secondary vapor; and wherein (b) is practiced at least in part using the secondary vapor.

8. A method as recited in claim 3 wherein the evaporation plant has 5–7 stages; and wherein the amount of alkaline waste liquor used in (a) is between about 10–20% of the total amount of alkaline liquor from the third stage of the evaporator plant to be evaporated.

9. A method as recited in claim 1 wherein (c) is practiced in a retention tank.

10. A method as recited in claim 1 wherein (a) is practiced using bleaching effluent comprising filtrate from an acidic bleaching stage.

11. A method as recited in claim 1 wherein (a) is practiced so that the volume of the alkaline waste liquor added increases the carbonate ion content in the bleaching effluent over the stoichiometric amount required for formation of calcium carbonate.

12. A method as recited in claim 1 wherein the heat treatment in (c) is performed at a temperature of between about 110–160° C.

13. A method as recited in claim 10 wherein the heat treatment in (c) is performed at a temperature of between about 110–145° C.

14. A method as recited in claim 11 wherein the heat treatment in (c) is performed at a temperature of between 115–140° C.

15. A method as recited in claim 1 further comprising (e) adjusting the pH of the bleaching effluent in (a) to a value higher than 11.

16. A method as recited in claim 15 wherein (e) is practiced by adding green liquor, white liquor, or sodium hydroxide to the bleaching effluent to adjust the pH to over 12.

17. A method as recited in claim 10 wherein (a) is practiced using bleaching effluent comprising a filtrate or a combination of filtrates from at least one of the following stages: an acid wash stage (A), an acidic or neutral chelation stage (Q), an acidic ozone stage (Z), an acidic peroxide stage (Pa), and a hot acid stage for removal of hexenuronic acid groups from cellulose pulp.

18. A method as recited in claim 1 wherein (c) is practiced with a retention time of between about 5–10 minutes.

19. A method as recited in claim 1 further comprising, prior to (a), evaporating the alkaline waste liquor in at least one evaporation stage to a dry matter content of between about 35–45%.

20. A method as recited in claim 11 further comprising pre-evaporating the bleaching effluent prior to (a), to pre-concentrate it to a dry matter content of between about 5–10%.

21. A method as recited in claim 11 wherein (a)–(c) are practiced using a ratio of bleaching effluent to alkaline waste liquor of between 2:1 to 5:1, in the combined effluent.

* * * * *